United States Patent [19]

Lipp

[11] 4,081,981

[45] Apr. 4, 1978

[54] APPARATUS FOR PRODUCING A PIPE FROM METAL STRIP

[76] Inventor: Xaver Lipp, 7091 Tannhausen, Ostalbkreis, Germany

[21] Appl. No.: 649,676

[22] Filed: Jan. 16, 1976

[30] Foreign Application Priority Data

| | | |
|---|---|---|
| Jan. 18, 1975 | Germany | 2501943 |
| Nov. 28, 1975 | Germany | 2553481 |

[51] Int. Cl.[2] ..... B21C 37/12; B21D 11/06

[52] U.S. Cl. ..... 72/49; 72/135; 72/66

[58] Field of Search ..... 72/49, 50, 135, 142, 72/66; 228/17.7

[56] References Cited

U.S. PATENT DOCUMENTS

| | | | |
|---|---|---|---|
| 3,314,141 | 4/1967 | Bacroix | 228/17.7 X |
| 3,417,587 | 12/1968 | Campbell | 72/50 |

FOREIGN PATENT DOCUMENTS

| | | | |
|---|---|---|---|
| 985,067 | 7/1951 | France | 72/50 |
| 861,536 | 2/1953 | Germany | 72/142 |

*Primary Examiner*—Francis S. Husar
*Assistant Examiner*—Gus T. Hampilos
*Attorney, Agent, or Firm*—Roylance, Abrams, Berdo & Kaul

[57] ABSTRACT

Apparatus for forming pipe from an elongated metal strip including a supply reel for the strip, an elongated tubular carrier, an axle at one end of the carrier for supporting the supply reel and edge-forming means for bending the edges of the strip to join them in a helical fashion to form the pipe wall. In one embodiment, the supply reel is supported at one end of the carrier and the strip is guided through the carrier and out through an opening near the other end. The carrier is supported for horizontal rotation. Near the opening there are guide rolls arranged in a helical path so that the strip emerges through the carrier, goes through the guide rolls, and then goes through the edge-forming devices including profiling and rabbeting rolls, also helically arranged. A motor is mounted at that end of the carrier and a chain drive from the motor drives the profiling and rabbeting rolls. In another embodiment, the supply reel and the guide rolls and profiling means are all at the same end of the carrier, the supply roll being supported within a frame and the guide and profiling rolls being supported on that same frame. The entire apparatus can be mounted on a carriage for longitudinal motion to advance as the pipe is produced. Alternatively, the forming apparatus can sit still while the pipe being produced is continuously withdrawn from the forming area.

10 Claims, 16 Drawing Figures

APPARATUS FOR PRODUCING A PIPE FROM METAL STRIP

This invention relates to an apparatus for producing a pipe from sheet metal strip.

An apparatus for producing pipe of the general nature disclosed in the present invention is shown in German Pat. (Offenlegungsschriften) No. 1,959,500. In that patent, the pipe being produced is arranged with a vertical axis with a frame on the pipe which has already been produced being movable. The frame is in the nature of a three-pronged star, at the ends of which movable wheels are disposed on the wall of the pipe. The frame can be rotated around its central axis and supports, in its middle, the supply roll of metal strip disposed coaxially. The frame supports a profiling and rabbeting station in the area determined by the wall of the pipe being produced. A driving motor disposed on the frame drives the rabbeting station and the rotatable frame.

The present invention relates to an apparatus for producing pipe in a horizontal direction, the apparatus being arranged so that it can either be movable to stationary during the production process. Briefly described, the apparatus includes an elongated sheet metal strip, a supply reel for the strip, an elongated horizontally mounted carrier, means for rotatably mounting the supply reel at an end of the carrier, profiling means for forming an edge of the strip, rabbeting means for joining adjacent edges of the strip, means for mounting the profiling means and the rabbeting means at an end of the carrier for substantially concentric motion with respect to the carrier, and guide means for guiding the strip withdrawn from the supply reel to the profiling and rabbeting means in a generally circular path, whereby the strip is joined to itself in a helical path to form an elongated pipe.

The use of an elongated carrier permits compact construction of an apparatus which can easily be made movable. In the case of stationary apparatus, the pipe which is disposed essentially horizontally must be shifted axially in accordance with the progress of its production, whereas in the case of the apparatus being movable, the pipe may remain stationary and the apparatus is moved in accordance with the progress of pipe production. It is also possible to move both the pipe and the forming apparatus in opposite directions, if desired.

In one aspect of the invention, the means for mounting the supply reel supports that reel for rotation about an axis transverse to the longitudinal axis of the carrier, and the guide means includes means for guiding the strip along a path parallel to the longitudinal axis of the carrier and the guide means also includes means for guiding the strip away from that parallel path and into a peripheral path with respect to the carrier. It will be realized that a sheet metal strip which is first guided along a straight line can be deflected without an abrupt bend or crack into a ring concentrically surrounding the straight line. Thus, it is possible to dispose the supply roll independently of the position of the profiling station at an axial distance from the portion of the pipe which is being produced. As a result of this, the supply roll becomes easily accessible and the diameter of the pipe that is to be produced can be established independently of the diameter of the supply roll.

The carrier itself can be a pipe so that, in a further aspect of the invention, the apparatus includes means for mounting the carrier for rotation about its longitudinal axis, the axis lying in a central plane of the supply reel, and in this embodiment the means for mounting the supply reel supports the reel for rotation about an axis transverse to the longitudinal axis of the carrier and the guide means guides the strip through the carrier to the profiling and rabbeting means. In this case, the guide means would include a guide roll at the end of the carrier adjacent the supply reel.

The carrier can be supported rotatably by bearings disposed between the supply reel and the profiling and rabbeting means, and can be provided with a driving motor having a housing attached to one end of the carrier opposite the end adjacent the supply reel, and a shaft coupled to the profiling and rabbeting means. In this arrangement, the apparatus makes use of the forces of action and reaction, the motor thereby serving to drive the rotatably mounted carrier as well as the sheet metal strip which forms the pipe being produced. In a different aspect of the invention, the mounting means for the supply reel includes a frame attached to an end of the carrier and the means for mounting the profiling and rabbeting means is supported on the frame. In this advantageous aspect of the invention, the sheet metal strip is guided around the supply reel whereby the envelopment of the apparatus by the strip may be in the order of one-half or a full circular arc, depending upon the pitch of the spiral developed before the sheet meal strip reaches the profiling station. The sheet metal strip reaches the profiling station in the shortest possible way where its edges are beveled corresponding to the rabbet that is to be produced and, from there, to the rabbeting station wherein the two joining edges of two adjacent windings are connected with one another.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
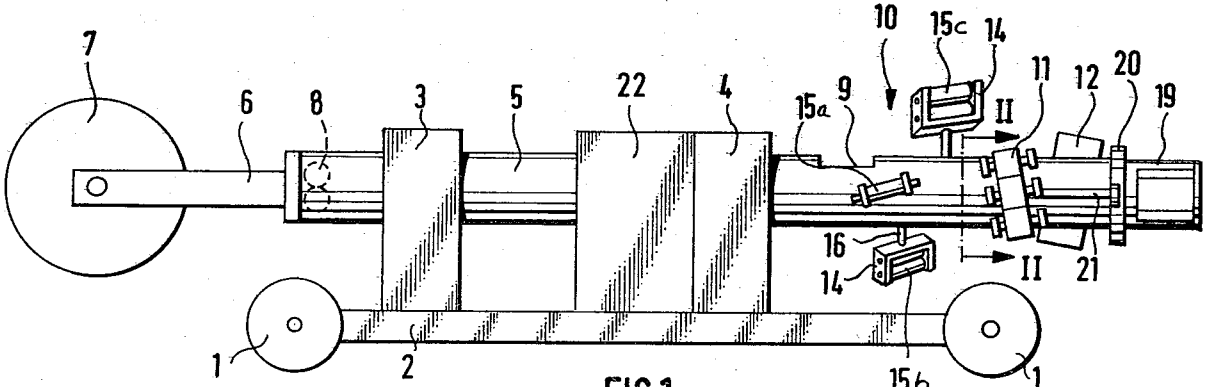
FIG. 1 is a side elevation schematically illustrating an apparatus according to the invention.

Turning now to FIG. 1, there is shown a frame or under-carriage 2 having wheels 1 which can be controlled and driven, as desired, by means not specifically illustrated. Two bearing carrier members 3 and 4 are mounted on carriage 2 and are spaced apart to rotatably support a tubular or pipe-shaped carrier 5 which is mounted to be rotatable about its longitudinal horizontally disposed axis. Each of bearings 3 and 4 can have a plurality of carrying rolls for the support and guidance of the carrier, the carrying rolls being mounted rotatably in side plates of the bearing frame. The bearing can also be reinforced, in conventional manner, depending upon the weight and size of the apparatus.

At one end of carrier 5 there is provided a fork 6 having two arms between which is supported a supply reel or roll 7 accommodating a roll of sheet metal strip, the reel being supported so that its rotational axle lies in a common plane with the longitudinal axis of carrier 5 and so that the longitudinal axis of the carrier runs in the longitudinal central plane of the supply roll. The bearing fork 6 is provided with a central aperture of the introduction of the sheet metal strip into the carrier 5, this aperture being between the two legs of the fork or bridge structure. The sheet metal strip is guided into the end of carrier 5 by a pair of guide rolls 8.

Near the other end of carrier 5, beyond bearing 4 from the supply reel, there is provided an exit hole 9 for the sheet metal strip. A guiding arrangement, indicated generally at 10, is disposed around and supported by the carrier adjacent and "downstream" of the exit hole. A profiling station 11 and a rabbeting station 12 follow the guide arrangement.

Figure 3:
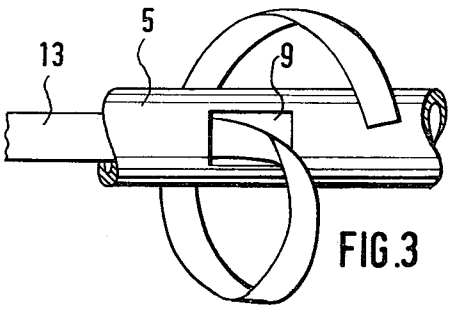
FIG. 3 is a partial plan view of the apparatus of FIG. 1 showing the approximate path of the metal strip.
Figure 4:
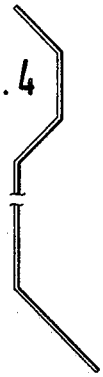
FIGS. 4–8 illustrate progressive formation of variably profiled edges of the sheet metal strip.
Figure 5:
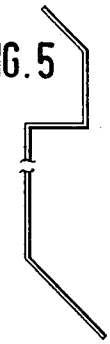
Figure 6:
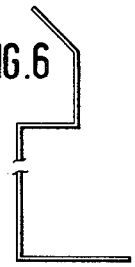
Figure 7:
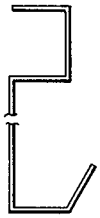
Figure 8:
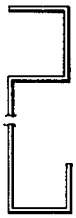
Figure 9:
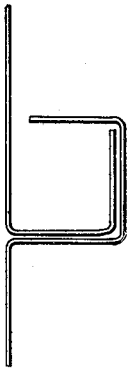
FIGS. 9–13 show progressive states of the connection of adjoining edges of sheet metal strips, FIGS. 4–13 being enlarged.
Figure 10:
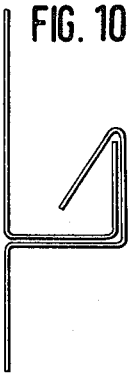
Figure 11:
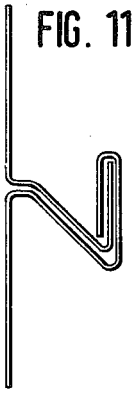
Figure 12:
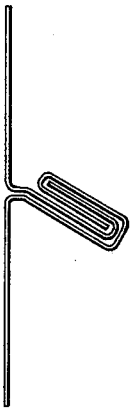
Figure 13:
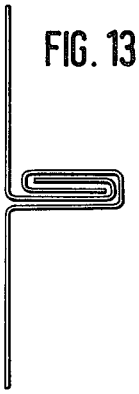

The sheet metal strip, which is not illustrated in FIG. 1 so that the apparatus itself can be more clearly seen follows a path which is generally illustrated in FIG. 3. In that figure, the guide rolls and the like are omitted so that the path of the sheet metal strip can be simply seen, the strip being caused to emerge from hole 9, after which it is conducted by the sequence of guide rolls into a path surrounding the carrier 5 in the form of a spiral. The conducting arrangement 10 for this purpose has several pairs of guide rolls illustrated at 15*a*, 15*b* and 15*c*. Each of the pairs of guide rolls is mounted in a U-shaped bearing carrier 14, which carrier is connected by means of a carrying rod 16 to the carrier 5. The rods 16 can be longitudinally adjustable with respect to the carrier to permit alteration of the overall size of the spiral path, depending upon the dimensions of the pipe to be produced.

In the profiling station 11 and the rabbeting station 12 pairs of rolls are combined into units which are similarly connected to carrier 5 by means such as carrying rods 17 and 18 which can also be made adjustable as to length with respect to the carrier 5. Again, this longitudinal adjustability of the carrying rods permits the production of pipes of various diameters.

Figure 2:
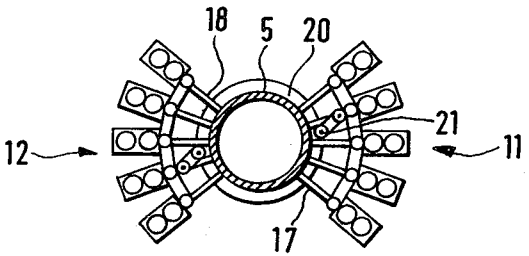
FIG. 2 is a section along lines II—II of FIG. 1.

At the opposite end of carrier 5 from the supply roll, there is provided a driving motor 19. The housing of motor 19 is connected to the end of carrier 5 and the shaft thereof is connected through a reduction gear box which is connected to drive the rollers of the profiling station 11 through a drive shaft 21 which is mounted in suitable bearings outside the carrier 5 and with its axis parallel to the carrier. In similar fashion, the rabbeting station 12, and also, if desired, at least one of the pairs of guide rolls 15*a*, 15*b* or 15*c* can similarly be driven. Drive shaft 21 drives the individual pairs of rollers of the profiling station 11, rabbeting station 12 and the guiding arrangement by way of a chain drive schematically illustrated in FIG. 2.

For the production of a pipe having a horizontal axis, the sheet metal strip 13, as shown in FIG. 3, emerges from the exit hole 9 of carrier 5 and is guided by means of the pair of guide rolls 15*a*, 15*b* and 15*c* of the guiding arrangement 10 into a position surrounding carrier 5 concentrically and helically. The sheet metal strip then enters profiling station 11 wherein the edges of the sheet metal strip are profiled corresponding to the foreshortened diagrams of FIGS. 4–8. Adjoining profiled edges of the sheet metal strip 13 are mutually connected in the rabbeting station 12 in the manner progressively indicated in FIGS. 9–13 to form a pipe. To accomplish this, motor 19 drives at least the profiling station 11 and, preferably, also the rabbeting station 12 and the guide rollers of guiding arrangement 10. The drive is selected corresponding to a safe driving of the sheet metal strip 13 from the supply roll 7 up to the size of pipe that is to be produced. On the basis of the reaction forces transmitted from the housing of the driving motor 19 to carrier 5, the carrier is rotated in bearings 3 and 4 around its longitudinal axis. The driving motor 19 can be interconnected with a power source, not shown, by means of power transmitting apparatus indicated at 22 disposed between bearings 3 and 4 by a control arrangement, also not shown, which can be provided in the transmission arrangement 22. As an example, device 22 can include slip rings and switching apparatus and also speed control devices, if desired.

The pipe being produced by the apparatus shown in FIG. 1 can be continuously withdrawn therefrom to the right as shown in FIG. 1, corresponding to its speed of production, in which case the production arrangement shown in FIG. 1 is maintained stationary. Alternatively, the pipe being produced can be maintained in a fixed position while the carriage 2 is caused to move to the left at a speed corresponding to the progress of pipe production. It is also possible to cause the apparatus of FIG. 1 to move in correspondence with a part of the progress of production of the pipe, while the pipe itself is caused to move away from the production arrangement corresponding to the remaining part of the production process, either simultaneously or sequentially.

Figure 14:
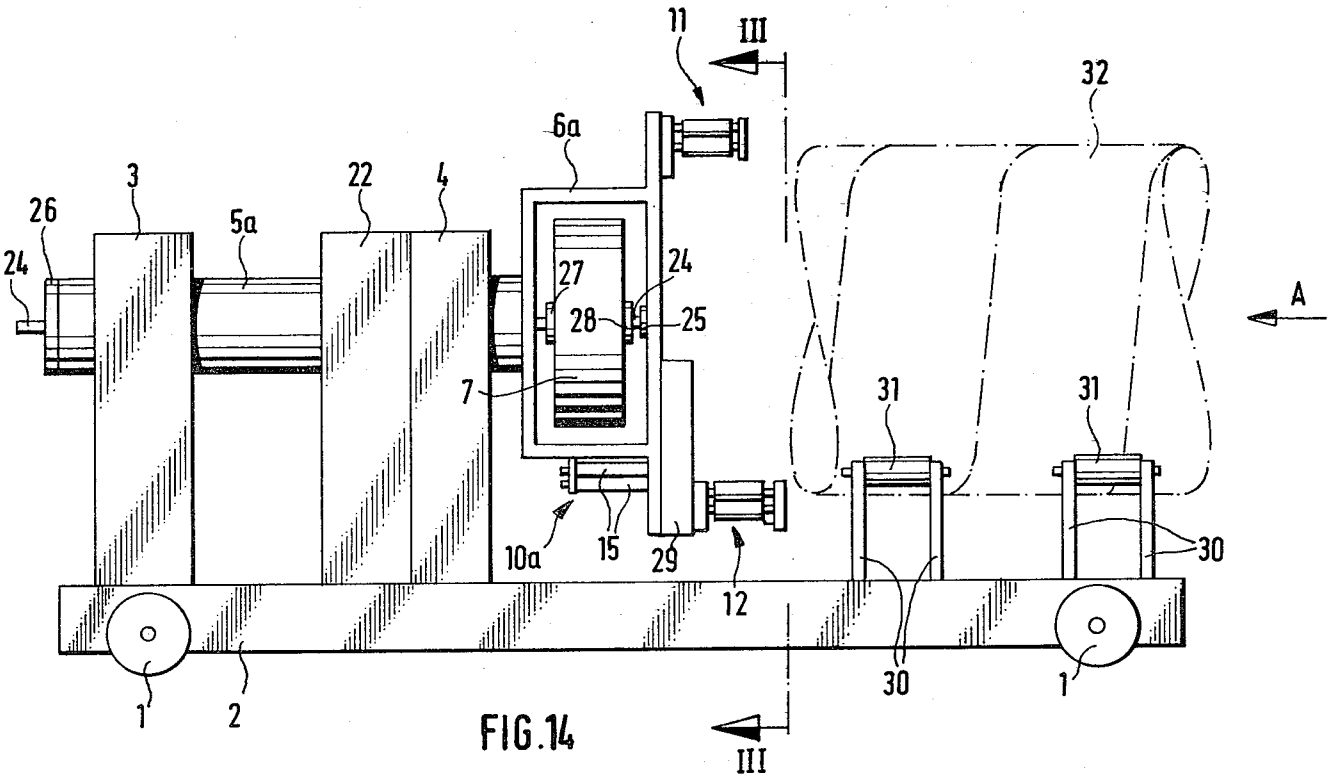
FIG. 14 is a side elevation schematically illustrating a second embodiment of the invention.
Figure 15:
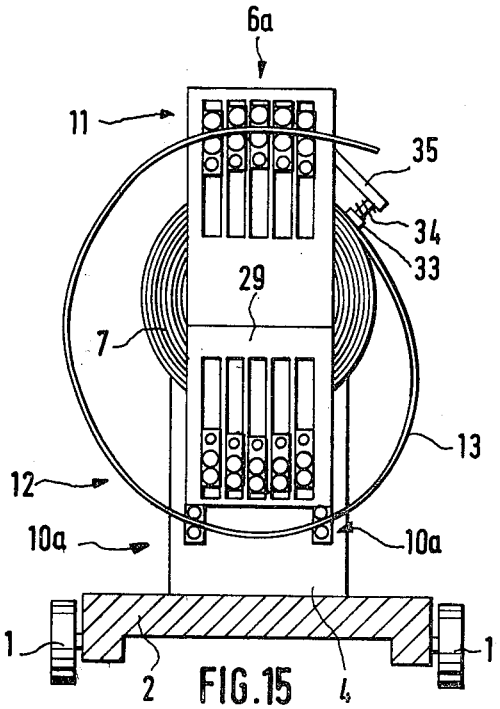
FIG. 15 is a section along lines III—III of FIG. 14.
Figure 16:
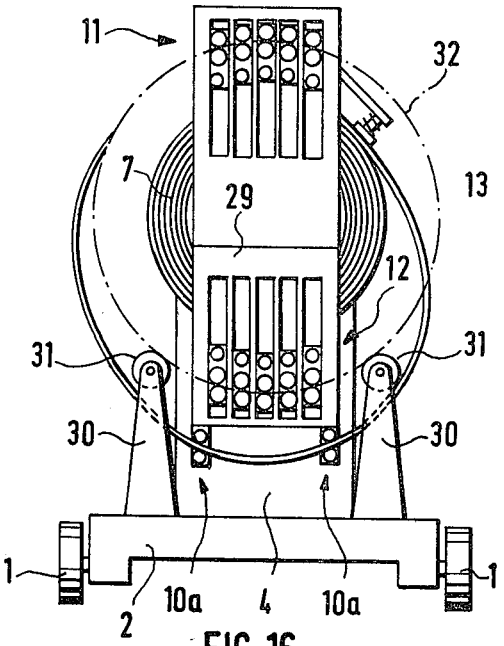
FIG. 16 is a schematic end elevation of the apparatus of FIG. 14 in the direction of arrow A.

A further embodiment of an apparatus according to the invention is shown in FIGS. 14–16 wherein a supply roll 7 is disposed at the end of a carrier 5*a* which is similarly supported in bearings 3 and 4. The supply roll is disposed within a portion 6*a* of a generally rectangular frame. The axle of the supply roll in this embodiment extends coaxially with the axis of carrier 5*a*. Frame 6*a* consists of welded rectangularly arranged sheet metal plates of which, in FIG. 14, only the relatively narrow edges are seen. Supply reel 7 is mounted on a rod-shaped axle 24 which extends beyond the ends of carrier 5*a*. At the supply roll end, the axle protrudes through the supply reel and is supported in a support member 25 attached to frame 6*a*. Axle 24 is supported at the other end in a supporting arrangement 26. The axle can be removed by extracting it beyond the end of the carrier near bearing 3 in order to insert a replacement roll of strip material, after which the axle is reinserted into support 25. A fixing arrangement 26 maintains the axle in the desired position. A collar 27 is fixedly attached to axle 24 on the side facing bearing 4, serving to secure the position of the supply roll 7. A detachable collar 28 on the opposite side of the supply reel can be removed from the axle and reattached thereto, this being to permit replacement of the supply roll.

On the portion of the frame facing away from bearing 4, the frame 6*a* is extended outwardly in opposite directions, one of the extended portions carrying the profiling station 11 and the other one supporting rabbeting station 12. The rabbeting station is attached to a baseplate 29, the thickness of which corresponds to about half the pitch of the pipe that is to be produced. Profiling station 11 and rabbeting station 12 preferably consists of individual pairs of rolls which can be actuated by a common motor or which can be supplied with individual motors and which can be adjusted primarily in a radial direction to permit production of various diameters of pipe.

Two guiding arrangements 10*a* are provided on frame 6*a*, the guiding arrangements having pairs of guide rolls 15 which serve to guide the sheet metal strip 13, the guide arrangement being disposed displaced in the direction toward the rabbeting station 12 on frame 6*a*.

In this embodiment, undercarriage 2 supports carrying rolls 31, each of which is mounted on a horizontal axis and is supported by members 30 so that the rollers 31 are freely rotatable. The carrying rollers 31 serve for supporting the pipe 32, which is illustrated in phantom lines, and which is produced by the described apparatus in a generally horizontal position. The sheet metal strip 13 unwinding from the supply roll 7 is guided by guiding arrangements 10*a* to the profiling station 11 where, as previously described, the deformations shown in FIGS. 4–8 are accomplished. Depending upon the pitch of the winding of sheet metal strip 13, the strip can pass from its position of unwinding on the supply roll 7 up to the entrance to the profiling station 11 by passing through almost a full circular arc and, in doing so, it can be guided through the guiding arrangements 10*a*. Alternatively, it can pass through only about half a circular arc without guidance through the guiding arrangements. After the profiling station 11, the profiled sheet metal strip reaches the rabbeting station 12 wherein two adjacent edges of the sheet metal strip are interconnected by rabbeting in correspondence with the arrangements progressively shown in FIGS. 9–13. The pipe thus produced is supported by carrying rolls 31. The actuation of profiling station 11 and of rabbeting station 12 is selected in such a way that during production of a stationary pipe, the vehicle moves in the direction of arrow A. Additionally, at least one of the guiding arrangements 10*a* can also be operated. On the basis of the reaction forces transmitted by the driving motor to the carrier 5*a*, the carrier is rotated about its longitudinal axis in bearings 3 and 4. The driving motor or motors can be connected with a power source, not shown, or separated therefrom, by means of a transmission arrangement 22 disposed between bearings 3 and 4 via control arrangement, not shown, as previously described.

In the case when the pipe being produced along a horizontal axis is withdrawn from the production arrangement shown in FIG. 14 in accordance with the progress of its production, then the production apparatus is maintained stationary. As previously indicated, when the pipe being produced is maintained in a fixed location, then the production arrangement is moved. As before, it is possible to move both the production apparatus and the pipe being produced in different directions, whereby the total movement corresponds to the progress of the pipe production.

Supply roll 7 can also be disposed between the rabbeting station 12 and the profiling station 11. In this case, the U-shaped section of frame part 6*a* is omitted and a plate carrying the profiling station and the rabbeting station is attached directly onto the end of pipe-shaped carrier 5*a*.

It is also possible to make the axle 24 accessible from that side of the plate which supports profiling station 11 and rabbeting station 12 and also to dispose the fixing arrangement there.

In order to prevent an uncontrolled dispensing or unrolling of the sheet metal strip from the supply roll, a brake shoe 33 can be provided, as shown in FIGS. 15 and 16. The brake shoe is supported resiliently by means of a spring 34 on a bearing arm 35 which is attached to frame 6*a* so that the brake shoe 33 is guided and radially urged against the supply roll.

Profiling station 11 and rabbeting station 12 can also be disposed immediately followng one another in the path of sheet metal strip 13, i.e., on the same side of frame 6*a*. In this case, it is desirable to provide a compensating weight on the other side of frame part 6*a* so that no unbalance occurs in the rotating apparatus.

It will also be observed that the profiling places of the profiling station are to be located on a diameter which is equal to or larger than the diameter of the pipe to be produced.

While certain advantageous embodiments have been chosen to illustrate the invention, it will be understood by those skilled in the art that various changes and modifications can be made therein without departing from the scope of the invention as defined in the appended claims.

I claim:

1. An apparatus for manufacturing pipe from an elongated sheet metal strip comprising a supply reel for said strip;

an elongated horizontally mounted hollow carrier having a central axis;

means operatively associated with said carrier for supporting said carrier for rotation about said central axis;

means operatively associated with said carrier for rotatably mounting said supply reel at an end of said carrier, said means including an axle for rotatably supporting said supply reel and mounting brackets for supporting said axle for rotation with said carrier, the central axis of said axle being perpendicular to the central axis of said carrier;

profiling means operatively associated with said carrier for forming an edge of said strip;

rabbeting means operatively associated with said carrier for joining adjacent edges of said strip;

means operatively associated with said carrier for mounting said profiling means and said rabbeting means on and radially outwardly of said carrier near the opposite end of said carrier from said supply reel for concentric motion with said carrier around said central axis;

means in said carrier defining an opening through a side wall thereof through which said strip can radially pass, said opening being located between said means for mounting said supply reel and said means for mounting said profiling means and rabbeting means;

guide means operatively associated with said carrier for guiding strip withdrawn from said supply reel longitudinally through said carrier parallel with said central axis of said carrier and generally radially through said opening to said profiling and rabbeting means in a generally circular path concentric with said central axis, whereby said strip is joined to itself in a helical path surrounding said carrier to form an elongated pipe.

2. An apparatus according to claim 1 wherein said guide means includes a guide roll at an end of and within said carrier adjacent said supply reel.

3. An apparatus according to claim 2 wherein said means for mounting said carrier includes bearings supporting said carrier between said supply reel and said profiling and rabbeting means.

4. An apparatus according to claim 3 and further comprising a drive motor having an output shaft and a housing attached to one end of said carrier opposite the end adjacent said supply reel, and a shaft coupled from said output shaft to said profiling and rabbeting means.

5. An apparatus according to claim 4 and further comprising a source of power operatively associated with a power transmitting means; said power transmitting means for supplying power to said motor disposed between said supply reel and said profiling means.

6. An apparatus according to claim 1 wherein said means for supporting said carrier includes carriage means operatively associated with said carrier for supporting said carrier; and wheel means for supporting said carriage means for movement parallel with the axis of said carrier.

7. An apparatus for manufacturing pipe from an elongated sheet metal strip comprising a supply reel for said strip;

an elongated horizontally mounted generally cylindrical carrier having a central axis;

means operatively associated with said carrier for supporting said carrier for rotation about said central axis;

means operatively associated with said carrier for rotatably mounting said supply reel at an end of said carrier, said means including an axle for rotatably supporting said supply reel and a mounting bracket for supporting said axle for rotation relative to said carrier, the central axis of said axle being parallel to the central axis of said carrier;

profiling means operatively associated with said carrier for forming an edge of said strip;

rabbeting means operatively associated with said carrier for joining adjacent edges of said strip;

means operatively associated with said carrier for mounting said profiling means and said rabbeting means on said carrier or the same end of said carrier as said supply reel and radially outwardly thereof for substantially concentric motion with said carrier around said central axis, said profiling and rabbeting means being radially outwardly disposed from said supply reel;

guide means operatively associated with said carrier for guiding strip withdrawn from said supply reel and generally radially outwardly to said profiling and rabbeting means in a generally circular path substantially concentric with said central axis, whereby said strip is formed at its edges by said profiling means and joined to itself by said rabbeting means in a helical path to form an elongated pipe around a central axis substantially aligned with the central axis of said carrier.

8. An apparatus according to claim 7 wherein said mounting bracket comprises a frame attached to an end of said carrier, and said means for mounting said profiling and rabbeting means is supported on said frame.

9. An apparatus according to claim 8 wherein said guide means is supported on said frame.

10. An apparatus according to claim 8 wherein said means for rotatably mounting said supply reel is adapted to permit removal and replacement of said reel.

* * * * *